US005522529A

United States Patent [19]

Yurman et al.

[11] Patent Number: 5,522,529

[45] Date of Patent: Jun. 4, 1996

[54] CLASP ASSEMBLY FOR A WATCH BRACELET

[75] Inventors: David Yurman, New York; Peter Roth, Holmes, both of N.Y.

[73] Assignee: Yurman Design, Inc., New York, N.Y.

[21] Appl. No.: 340,839

[22] Filed: Nov. 17, 1994

[51] Int. Cl.[6] ..... A44C 5/18

[52] U.S. Cl. ..... 224/176; 224/164; 224/179; 63/21; 24/613; 24/313; 24/265 BC

[58] Field of Search ..... 224/164, 166, 224/169, 174, 179, 176; 63/7, 8, 9, 21, 24; 24/312, 313, 310, 311, 265 BC, 612, 613

[56] References Cited

U.S. PATENT DOCUMENTS

| | | | |
|---|---|---|---|
| 1,054,401 | 2/1913 | Eklund | 63/7 |
| 2,028,791 | 1/1936 | Lynds | 224/174 |
| 4,150,464 | 4/1979 | Tracy | 24/313 |
| 4,604,772 | 8/1986 | Arff | 24/311 |

FOREIGN PATENT DOCUMENTS

| | | | |
|---|---|---|---|
| 1413263 | 8/1965 | France | 24/613 |
| 109129 | 9/1943 | Sweden | 224/179 |
| 9012519 | 11/1990 | WIPO | 63/21 |

OTHER PUBLICATIONS

Advertising brochure illustrating Style B4361 (No Publication Date Available).

*Primary Examiner*—Henry J. Recla
*Assistant Examiner*—Gregory M. Vidovich
*Attorney, Agent, or Firm*—Gottlieb, Rackman & Reisman

[57] ABSTRACT

A clasp assembly for selectively connecting and disconnecting a pair of bands which define a watch bracelet is described. The clasp assembly includes a male coupling defined by a housing and a depending insert, and a female coupling having an inside wall which defines an opening that is sized to selectively receive the insert of the male coupling. The clasp assembly also includes a pair of tab members which overlie the insert for selectively engaging the female coupling member along the inside wall thereof. The clasp assembly further includes a spring which is operatively connected between the two tab members to enable the user to selectively lock and unlock the insert from the female coupling.

17 Claims, 4 Drawing Sheets

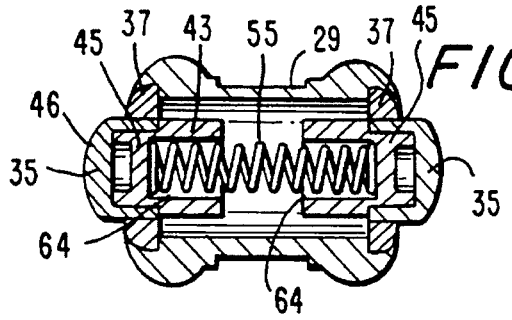
FIG. 4
FIG. 5
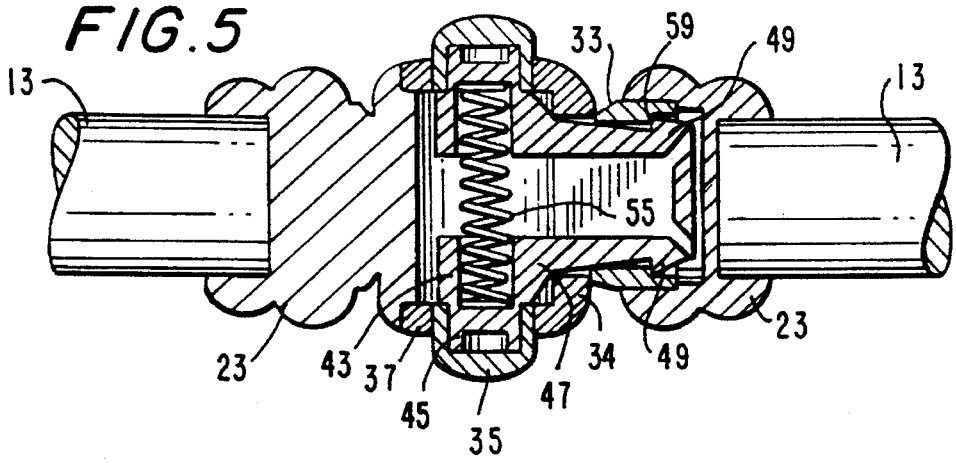
FIG. 6
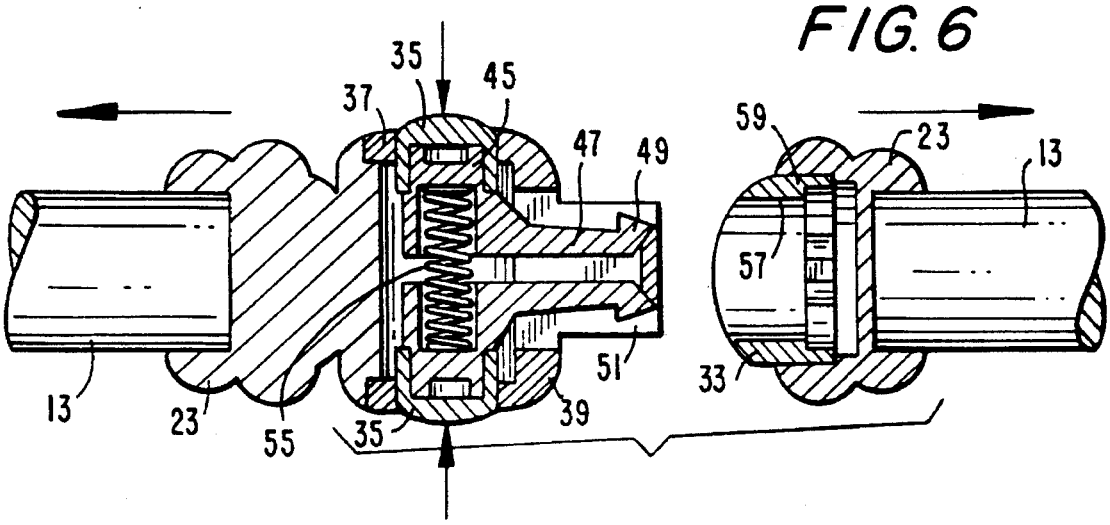

CLASP ASSEMBLY FOR A WATCH BRACELET

BACKGROUND OF THE INVENTION

This invention relates to a clasp assembly for a watch bracelet, and more particularly, to a clasp assembly for selectively connecting and disconnecting a pair of inflexible bands which comprise the watch bracelet assembly.

Watch bracelets are well known in the prior art, and are worn by numerous individuals in order to create a specific aesthetic appearance or statement, and for the purpose of informing the wearer of the time. All watch bracelets comprise a watch case which displays the time, either numerically or with a conventional hour/minute/second hand clock configuration. The watch bracelet will also include some type of band which can be wrapped around the wrist or lower arm portion of the wearer so that the bracelet assembly is fixed in place.

In some instances, the watch bracelet comprises a series of link members which are interconnected and which are flexible enough to enable the bands to enlarge so that the watch bracelet assembly may be easily taken off and put on the wearer's wrist. In other situations, the watch bracelet assembly comprises a pair of inflexible metal bands that are fixed to opposite ends of the watch case, and which are sized when connected to each other to fit snugly around the wearer's wrist. While this type of assembly is advantageous since the watch bracelet has a more customized fit, the difficulty is providing a mechanism for connecting the two bands at their free ends that is easy and simple to operate. This is especially required since such connection most often takes place while the watch band segments are wrapped around the wearer's wrist and the wearer only has one free hand with which to interconnect the band ends.

Accordingly, it would be desirable to provide a clasp assembly for a watch bracelet of the type described above and which enables the watch assembly wearer to easily and quickly interconnect the two free ends of the watch band segments in order to secure the watch assembly to a wearer's wrist.

SUMMARY OF THE INVENTION

Generally speaking, in accordance with the invention, a clasp assembly for selectively connecting and disconnecting a pair of band segments which define a watch bracelet is described. The clasp assembly includes a male coupling defined by a housing and a depending insert and a female coupling having an inside wall which defines an opening that is sized to selectively receive the insert of the male coupling. The clasp assembly also includes a pair of tab members which overlie the insert for selectively engaging the female coupling member along the inside wall thereof. The clasp assembly further includes a spring which is operatively connected between the two tab members to enable the user to selectively lock and unlock the insert from the female coupling.

The clasp assembly of the invention enables the operator to easily open and close the watch bracelet so that the watch bracelet can be easily and quickly put on or off the wrist of the wearer. Preferably, the watch bracelet is also provided with a pair of hinge assemblies disposed on either side of the watch case to enable the watch bands to pivot along the hinge assemblies when disconnecting the two ends of the band by means of the inventive clasp assembly.

Although the clasp assembly of the invention is preferably used in a watch bracelet, it may also be used in connection with other types of jewelry items.

Accordingly, it is an object of the invention to provide an improved clasp assembly for a watch bracelet.

Another object of the invention is to provide a clasp assembly for a watch bracelet that comprises a male coupling and a female coupling for selectively receiving the male coupling.

Still a further object of the invention is to provide a clasp assembly which enables the band segments of the band of a watch bracelet to be easily attached or separated.

Yet another object of the invention is to provide a clasp assembly for a watch bracelet that includes one or more tabs for selectively engaging the female coupling.

A further object of the invention is to provide a clasp assembly for a watch bracelet that incorporates a spring mechanism that is operatively connected with the one or more tabs to enable the operator to selectively lock and unlock the watch bracelet clasp.

Still other objects and advantages of the invention will in part be obvious and will in part be apparent from the following description.

The invention accordingly comprises the assembly possessing the features, properties and relation of components which will be exemplified in the assembly hereinafter described, and the scope of the invention will be indicated in the claims.

BRIEF DESCRIPTION OF THE DRAWINGS

For a fuller understanding of the invention, reference is made to the following description, taken in connection with the accompanying drawings, in which:

FIG. 4 is a cross-sectional view taken along line 4—4 of FIG. 3;

FIG. 5 is a cross-sectional view taken along line 5—5 of FIG. 3;

FIG. 6 is similar to FIG. 5 and illustrates the clasp assembly of the invention in an unlocked or disconnected condition.

DETAILED DESCRIPTION OF THE PREFERRED EMBODIMENT

Figure 1:
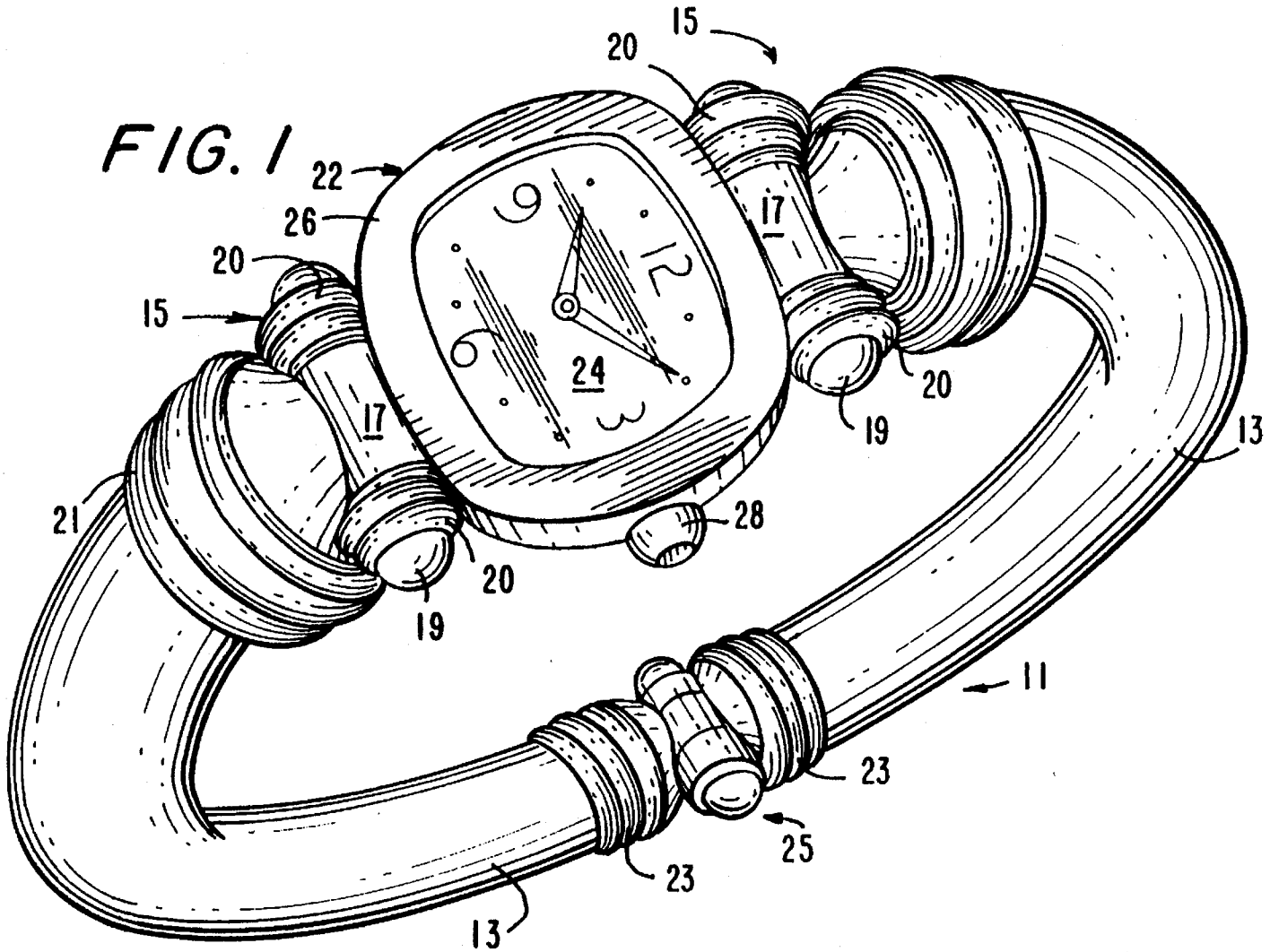
FIG. 1 is a perspective view of a watch bracelet that includes the inventive clasp assembly incorporated between the two bracelet band segments.
Figure 2:
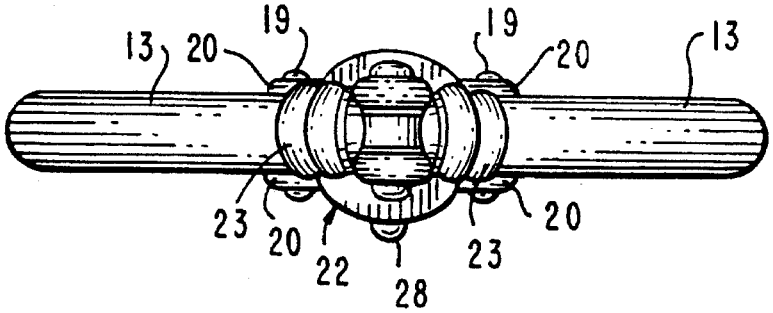
FIG. 2 is a top plan view illustrating the watch bracelet with the inventive clasp assembly.
Figure 3:
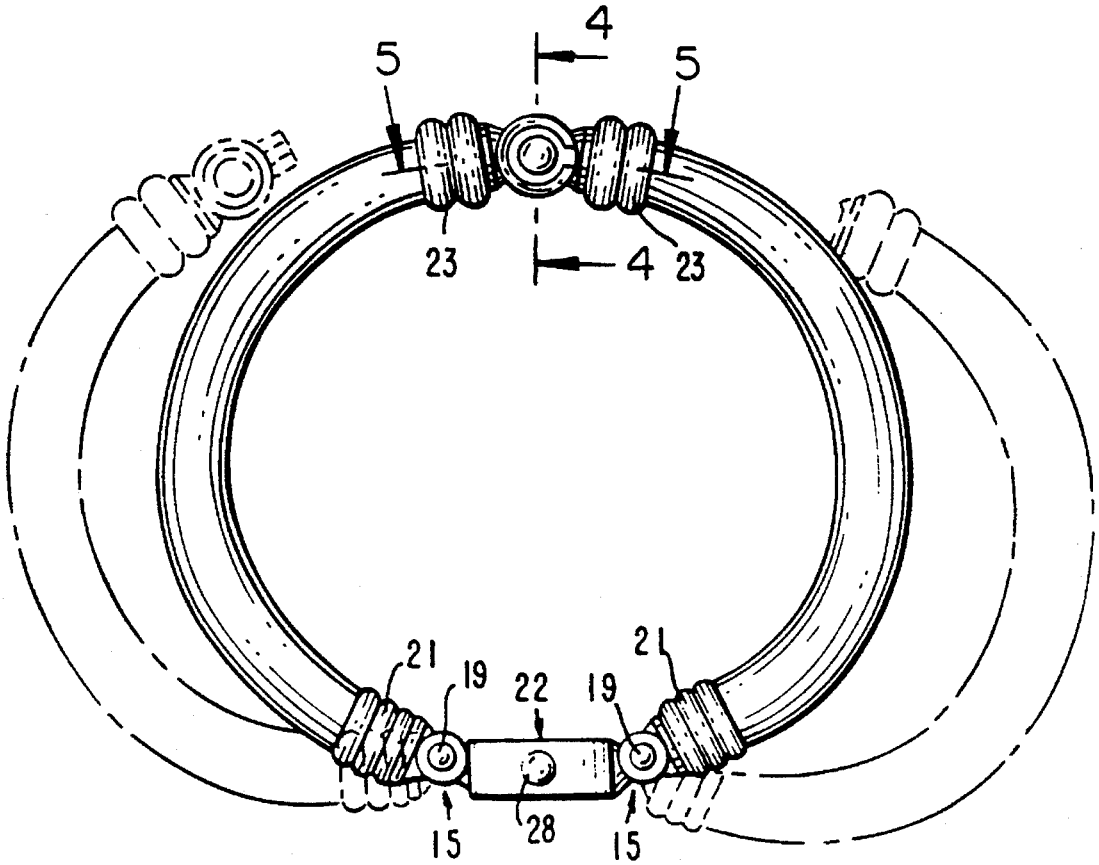
FIG. 3 is a front elevational view of the watch bracelet depicted in FIGS. 1 and 2 and illustrating both the clasp assembly of the invention and the hinge assemblies for pivotally connecting the two band segments to the watch case. The drawing in phantom illustrates the bracelet in a unlocked condition.

Referring first to FIGS. 1–3, a watch bracelet assembly generally indicated at 11 which incorporates the clasp assembly of the invention is now described. Bracelet assembly 11 includes a pair of inflexible band segments 13 which when joined make up a complete watch band, with each band segment leading into a forward head 23 and a rear head 21. Heads 23 of band segments 13 are selectively connected by means of a clasp assembly in accordance with the invention, as will be described hereinafter. Heads 21 are each connected to a watch case 22 by means of a hinge assembly generally indicated at 15. Watch body 22 includes a face 24, a case 26, and time adjusting knob or crown 28 as is well known in the art. Hinge assemblies 15 are used to enlarge the wrist opening defined by watch bracelet assembly 11 when band segments 13 are disconnected, as shown in FIG. 3, so that bracelet assembly 11 can be removed from the wearer's wrist.

Each hinge assembly 15 comprises a first bearing 17 fixed to and projecting from watch body 22, and a pair of second bearings 20 fixed to and projecting from head 21 of band 13. The two bearings are interconnected such that an aligned pathway is formed therethrough for receiving a pivot pin 19. Pivot pin 19 is irrotatably mounted in one of the bearings and rotatably mounted in the other of the bearings to enable each band 13 to pivot about case 22, as best shown in FIG. 3. Preferably, at least one end of pivot pin 19 is formed with a head (not shown) or some other means to prevent pin 19 from sliding out of the two bearings.

Figure 7:
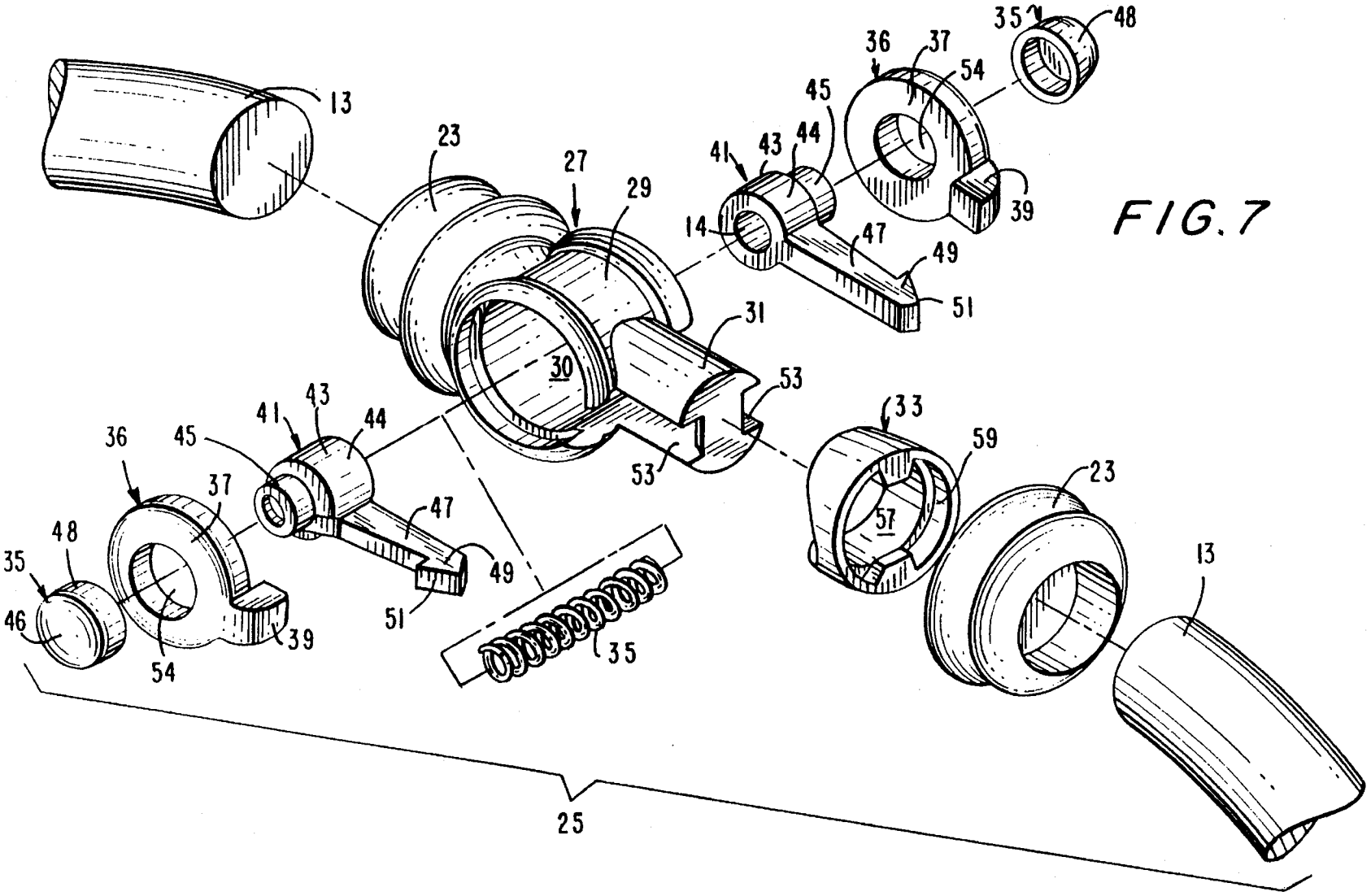
FIG. 7 is an exploded perspective view illustrating the various component parts of the inventive clasp assembly.

Turning now to FIGS. 4, 5 and 7, clasp assembly 25 of the invention is now described. Clasp assembly 25 comprises a male coupling 27 and a female coupling 33, as best shown in FIG. 7. Male coupling 27 comprises an annular drum 29, head 23 (described before) that is fixed to one side of drum 29, and an insert member 31 located on the other side of housing 29 and depending therefrom. Drum 29 defines a passageway 30 running therethrough, while insert 31 includes a pair of longitudinally extending slots 53. Openings 30 and slots 53 are sized for receiving the tabs of the inventive clasp assembly, as described in greater detail below.

Female coupling 33 has a substantially annular configuration which defines an annular inner wall 57 with a lip 59 formed therealong. Insert 31 is received at least in part within head 23 of band 13 when clasp assembly 25 is in a coupled condition, as best shown in FIG. 5.

Continuing with FIG. 7, clasp assembly 25 further includes a pair of tab assemblies generally indicated at 41 mounted within and along side housing 29. Tab assembly 41 comprises a head 43 with an inwardly facing opening 64, a sidewall 44, and a spacer 45 projecting from sidewall 44 of head 43. Tab assembly 41 further includes a depending finger 47 which leads to a tab or catch 49. Tab 49 includes a camming surface 51 which selectively engages inside wall 57 (past annular lip 59) of female coupling 33 in order to lock insert 31 of male coupling 27 inside female coupling 33, as shown in FIG. 5.

As shown in FIG. 7, clasp assembly 25 further includes a pair of collar members 36, each comprising an annular ring 37, with an opening 54 formed therein. Ring 37 is disposed over spacer 45 and seated on sidewall 44 of tab assembly head 45, as shown in FIG. 5. This facilitates locking of each tab assembly 41 within the openings leading to passageway 30 defined by drum 29 of male coupling 27. Collar member 36 further includes a depending shoulder 39 projecting from sidewall 36 which wraps around drum 29, as best shown in FIG. 5.

The clasp assembly of the invention further includes a button 35 which is seated over spacer 45 of tab assembly 41, as shown in FIGS. 4 and 5. Button 35 includes a top 46 on which a force is applied to operate clasp assembly 25, as discussed below, and an annular side wall 48 which fits around and over spacer 45. Annular wall 48 also is disposed within opening 44 defined by ring 37 of sealing member 36, as best shown in FIG. 4.

Continuing with FIG. 4 and FIG. 5, each of tab assemblies 41 are operatively interconnected by a longitudinally extending spring member 55. Spring member 55 runs through passageway 30 defined by drum 24 of male coupling 27 such that the spring ends are received in opening 64 defined by head 43 of tab assembly and abut against the bottom surface of spacers 45. The ends of spring member 55 urge spacers 45 and hence attached buttons 35 in an outward direction.

In operation of clasp assembly 25, at least one but desirably both of buttons 35 must be pressed inwardly to produce an inwardly directed force which exceeds the outward compression force exerted by spring member 55. As a result, each of tab assemblies 45 will move inwardly, as best shown in FIG. 6, such that camming surfaces 51 of tabs 49 are no longer engaged along inner wall 57 (past annular lip 59) of female coupling 33. Consequently, insert 31 can then be removed from within female coupling 33 in order to disconnect bands 13 from each other, as shown in FIG. 6.

In order to reconnect bands 13, insert 31 of male coupling 27 is pushed inside female coupling 33 such that camming surface 51 of tabs 49 ride along inner wall 57. When tabs 49 reach past annular lip 59 of inner wall 57, the force created by spring member 55 urges tabs 49 of assembly 41 outwardly so that tabs 49 grab inner wall 57. As a result, tab assembly 41 cannot be removed within female coupling 33 since tabs 49 are locked in position past annular lip 59. Thus, clasp assembly 25 will remain in a closed or locked condition until such time as the operator as desired, pushed buttons 35 of clasp assembly 25 inwardly, as described above.

As shown in FIG. 1, the configuration or design of clasp assembly 25 as it appears when band segments 13 of assembly 11 are in a locked condition is substantially similar to that of the two hinge assemblies 15 connected to either side of watch case 22. As a result, watch bracelet assembly 11 has an aesthetically pleasing appearance when worn on a wearer's wrist.

It will thus be seen that the objects set forth above, among those made apparent from the preceding description, are efficiently attained, and since certain changes may be made in the assembly described hereinabove without departing from the spirit and scope of the invention, it is intended that all matter in the above description and shown in the accompanying drawings shall be interpreted as illustrative and not in a limiting sense.

It is also to be understood that the following claims are intended to cover all of the generic and specific features of invention herein described and all statements of the scope of the invention which, as a matter of language, may be said to fall therebetween.

We claim:

1. A clasp assembly for selectively interconnecting a pair of band segments of a watch or jewelry bracelet assembly comprising:

a male coupling comprising a drum and an insert depending therefrom;

a female coupling having an inside wall defining an opening sized to selectively receive the insert of said male coupling;

means for selectively locking said insert into the opening of said female coupling comprising at least one tab assembly at least partially overlying said insert and spring means for urging said at least one tab assembly to engage said female coupling along the inside wall thereof, said tab assembly comprising a head interengaged with said spring means, an outwardly extending spacer, and a finger transversely depending from said head and at least partially overlying said insert, said finger including a tab for selectively engages a annular lip running along said inside wall of said female coupling in response to said spring means; and means cooperating with said tab means for enabling selective unlocking of said insert from said female coupling.

2. The assembly of claim 1, wherein the drum of said male coupling defines a passageway through which said spring means extends.

3. The assembly of claim 1, wherein said depending insert includes at least one slot for at least partially receiving said at least one tab assembly.

4. The assembly of claim 1, wherein said at least one tab assembly includes a pair of tab assemblies, each of which overlies said insert of said male coupling along either side thereof.

5. The assembly of claim 4, wherein said insert includes a pair of side slots for receiving each of said fingers of said tab assemblies.

6. The assembly of claim 5, wherein said unlocking means comprises means for inwardly compressing said spring means for selectively disengaging said fingers of said tab assemblies from said inside wall of said female coupling.

7. The assembly of claim 6, wherein said compressing means comprises a pair of buttons operatively mounted over said outwardly extending spacers of said tab assemblies.

8. A clasp assembly for selectively interconnecting a pair of bands of a watch or jewelry bracelet assembly comprising;

a male coupling comprising a drum and an insert depending therefrom;

a female coupling having an inside wall defining an opening sized to selectively receive the insert of said male coupling;

means for selectively locking said insert into the opening of said female coupling comprising at least one tab means at least partially overlying said insert and spring means for urging said at least one tab means to engage said female coupling along the inside wall thereof;

wherein said tab means includes at least one tab assembly comprising a head for engaging one end of said spring means, and a finger transversely depending from said head, at least partially overlying said insert and selectively engaging the inside wall of said female coupling;

means for selectively compressing said spring means for selectively disengaging said finger of said at least one tab assembly from said inside wall of said female coupling; and means for maintaining said at least one tab means in position partially overlying said insert comprising annular collar means disposed over said head of said tab means and interengaging said drum of said male coupling.

9. The assembly of claim 8, wherein the drum of said male coupling defines a passageway through which said spring means extends.

10. The assembly of claim 8, wherein said depending insert includes at least one slot for at least partially receiving said finger of said at least one tab assembly.

11. The assembly of claim 8, wherein said female coupling includes a lip running along said inside wall past which said finger of said at least one tab assembly selectively engages.

12. The assembly of claim 8, wherein said at least one tab assembly further includes an outwardly extending spacer.

13. The assembly of claim 12, wherein said compressing means comprises a button mounted over said extending spacer.

14. A watch bracelet assembly comprising:

A watch case;

first and second watch band segments connected by first ends to opposite sides of said watch case and sized for wrapping around a wearer's wrist when interconnected at second ends thereof;

first and second hinge means for pivotally connecting the first ends of said first and second watch band segments respectively to said watch case; and clasp means for selectively interconnecting said second ends of said first and second watch bands, said clasp means comprising a male coupling comprising a drum and a depending insert, a female coupling having an annular inside wall defining an opening sized to selectively receive the insert of said male coupling, means for selectively locking said insert into the opening of said female coupling comprising at least one tab means at least partially overlying said insert and spring means for urging said at least one tab means to engage said female coupling along the annular inside wall thereof;

wherein the tab means includes at least one tab assembly comprising a head for engaging one of said spring means, and a finger transversely depending from said head, at least partially overlying said insert and adapted to selectively engage the annular inside wall of said coupling.

15. The watch bracelet assembly of claim 14, wherein said clasp means further includes means for selectively compressing said spring means for selectively disengaging said finger of said at least one tab assembly from said annular inside wall of said female coupling.

16. The watch bracelet assembly of claim 14, wherein said clasp means further includes means for maintaining said at least one tab means in position partially overlying said insert comprising collar means disposed over said head of said tab means and interengaging said drum of said male coupling.

17. The watch bracelet assembly of claim 14, wherein each of the first and second hinge means and clasp means have essentially identical outward appearances.

* * * * *